United States Patent [19]

Coughenour et al.

[11] 4,092,938

[45] June 6, 1978

[54] SEWING MACHINE WITH PROGRAMMABLE MEMORY

[75] Inventors: Donald Jay Coughenour, Morristown; John Addison Herr, Garwood, both of N.J.

[73] Assignee: The Singer Company, New York, N.Y.

[21] Appl. No.: 709,048

[22] Filed: Jul. 27, 1976

[51] Int. Cl.[2] ..... D05B 3/02

[52] U.S. Cl. ..... 112/158 E; 318/568

[58] Field of Search ..... 112/158 E, 121.11, 121.12; 318/568; 340/172.5

[56] References Cited

U.S. PATENT DOCUMENTS

| | | | |
|---|---|---|---|
| 3,449,540 | 6/1969 | Yanko et al. | 318/568 X |
| 3,581,285 | 5/1971 | Neema | 340/172.5 |
| 3,750,186 | 7/1973 | Sakamoto | 112/121.12 X |
| 3,872,808 | 3/1975 | Wurst | 112/158 E |
| 3,934,186 | 1/1976 | Hayakawa et al. | 318/568 X |
| 3,982,491 | 9/1976 | Herzer et al. | 112/121.12 |

OTHER PUBLICATIONS

Uimari, "PROMs–A practical alternative to random logic", Electronic Products, Jan. 21, 1974, vol. 16, No. 8, pp. 75, 76, 77, 82, 87, 91.

*Primary Examiner*—Peter Nerbun

*Attorney, Agent, or Firm*—Edward L. Bell; Robert E. Smith; Julian Falk

[57] ABSTRACT

This disclosure relates to electronically controlled sewing machines and in particular to the combination of such a machine with a re-programmable static memory with which an operator can program in input data representative of stitch position coordinates for selected patterns, which input data will be stored and decoded into input signals for initiating operation of the sewing machine stitch position actuating means to produce patterns corresponding to the operator selected pattern. The re-programmable memory can be located remote from the machine or can be built in as an integral part of the structure of the machine itself. The machine may also contain a static read-only-memory (ROM) having fixed patterns for operation of the machine with or without a re-programmable memory and includes switching means for disconnecting the read-only-memory when the re-programmable memory is connected to the machine.

14 Claims, 7 Drawing Figures

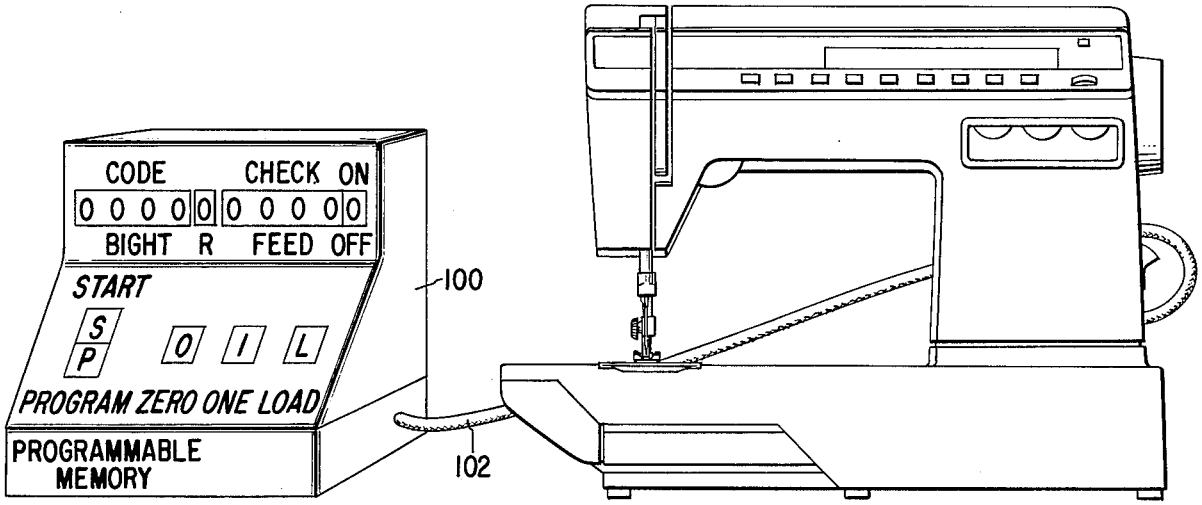
Fig. 2
Fig. 7
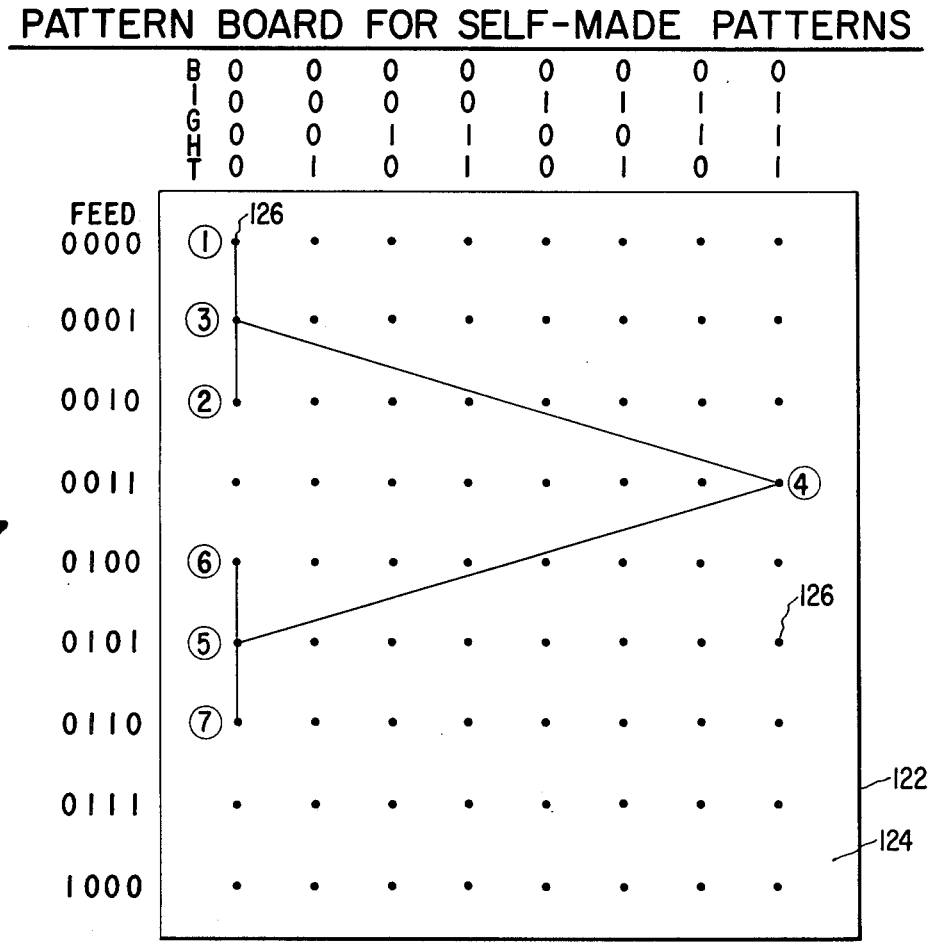

| PATTERN | NAME | STITCH | BIGHT | ± | FEED |
|---|---|---|---|---|---|
|  | ZIG-ZAG | 1 | 0000 | 0 | 0000 |
| | | 2 | 0110 | 0 | 0001 |
| | | 3 | 0000 | 0 | 0001 |
|  | OVEREDGE | 1 | 0000 | 0 | 0000 |
| | | 2 | 0000 | 0 | 0010 |
| | | 3 | 0000 | 1 | 0001 |
| | | 4 | 0110 | 0 | 0010 |
| | | 5 | 0000 | 0 | 0010 |
| | | 6 | 0000 | 1 | 0001 |
|  | GREEK KEY | 1 | 0000 | 0 | 0000 |
| | | 2 | 0000 | 0 | 0011 |
| | | 3 | 0010 | 0 | 0000 |
| | | 4 | 0010 | 1 | 0010 |
| | | 5 | 0110 | 0 | 0000 |
| | | 6 | 0110 | 0 | 0011 |
|  | SURF | 1 | 0000 | 0 | 0000 |
| | | 2 | 0000 | 0 | 0001 |
| | | 3 | 0001 | 0 | 0001 |
| | | 4 | 0010 | 0 | 0000 |
| | | 5 | 0011 | 1 | 0001 |
| | | 6 | 0010 | 1 | 0001 |
| | | 7 | 0011 | 1 | 0001 |
| | | 8 | 0100 | 0 | 0000 |
| | | 9 | 0101 | 0 | 0001 |
| | | 10 | 0110 | 0 | 0010 |
| | | 11 | 0101 | 0 | 0000 |
| | | 12 | 0100 | 0 | 0000 |
| | | 13 | 0010 | 0 | 0001 |
| | | 14 | 0000 | 0 | 0010 |

SEWING MACHINE WITH PROGRAMMABLE MEMORY

BACKGROUND OF THE INVENTION

In recent times an electronically controlled sewing machine has been introduced into the marketplace and is generally of the type illustrated in U.S. Pat. No. 3,872,808, issued Mar. 25, 1975. In such a machine a static read-only-memory device is provided in which is stored stitch pattern coordinates for the needle positions and fabric feed positions for a selected number of stitch patterns. Upon selection of a pattern from a pattern display on a machine, the read-only-memory is addressed and information is released in accordance with timing pulses coordinated with the mechanism of the machine which signals are converted from digital to analogue form and fed to an actuating mechanism for the needle position and the fabric feed position to reproduce the selected pattern. With such machines the number of patterns that can be selected is restricted in accordance with the capacity of the read-only-memory device and once the patterns are fed into such a memory they are locked therein. In other words, the machine does not possess the capability of reprogramming or selective programming by operator generated information.

Dynamic programming devices such as tape drives of the magnetic and punched varieties, for example, are not practical for use in sewing machines since they require relatively elaborate power supplies for their operation. Also, tape-type memories must be recorded and read sequentially, and therefore, the operator cannot select patterns at random or from different sections of the memory at will. One such device applied to a sewing machine is illustrated in Japanese Patent Publication No. 15713/70 published on June 1, 1970. However, the machine disclosed in the Japanese patent only purports to provide needle control for production of geometric patterns and is not capable of producing non-geometric patterns which require both signals for the needle and the fabric feed. Further, a machine of this type has never been successfully introduced into the market place.

One solution to the problem of providing a re-programmable memory for a sewing machine has been proposed and disclosed in U.S. Patent application Ser. No. 631,776, filed Nov. 13, 1975 by Herr et al. and assigned to the same assignee as the present application. In this referenced application, a magnetizable material is utilized for the memory which can be selectively magnetized by the operator in accordance with pattern instructions. The magnetizable memory is then read by the machine to reproduce the pattern either by mechanical means or electronic means.

GENERAL DESCRIPTION OF INVENTION

The present application provides for a static type of re-programmable memory and sewing machine combination through which digital information may be put directly into the memory by the operator and does not require an intermediate reading device to read the program from the memory and then convert the information read therefrom into digital information. In one embodiment of the present invention the re-programmable device is located remote from the sewing machine and is readily removable therefrom and the machine is capable of being operated by information from the reprogrammable memory device when connected thereto or separately from a read-only-memory incorporated within the machine when the remote re-programmable memory is disconnected therefrom. A further embodiment of the invention provides for the location of the re-programmable memory device to be integral with the machine so that the operator can input a selected pattern directly into the sewing machine display panel on the front thereof. When used herein, the term programmable memory preferably refers to a storage device of the static random access memory type (RAM) capable of being programmed upon introduction of programming instructions for temporary storage of such instruction and release therefrom upon proper address and includes a random access memory which may be programmed with all desired stitch coordinates capable of being reproduced by a sewing machine and when addressed with proper code information releasing the stitch coordinate information in accordance with the address code information.

Accordingly, it is an object of the invention to provide a novel electronically controlled sewing machine having a programmable device which can be programmed by the operator to provide stitch patterns of the operator's own choosing, if desired. It is also an object of the invention to provide a remote programmable memory device for use with the sewing machine for inputing digital signals to the machine for controlling the stitch pattern instrumentalities of the machine. Other objects and advantages of the invention will be best understood upon reading the following detailed description with the accompanying drawings.

DESCRIPTION OF THE DRAWINGS

In the accompanying drawings of preferred embodiments of the invention;

FIG. 2 is a view of a sewing machine and remote static programmable memory with the machine shown in front plan view and the memory shown in perspective view.

DESCRIPTION OF PREFERRED EMBODIMENT

Figure 1:
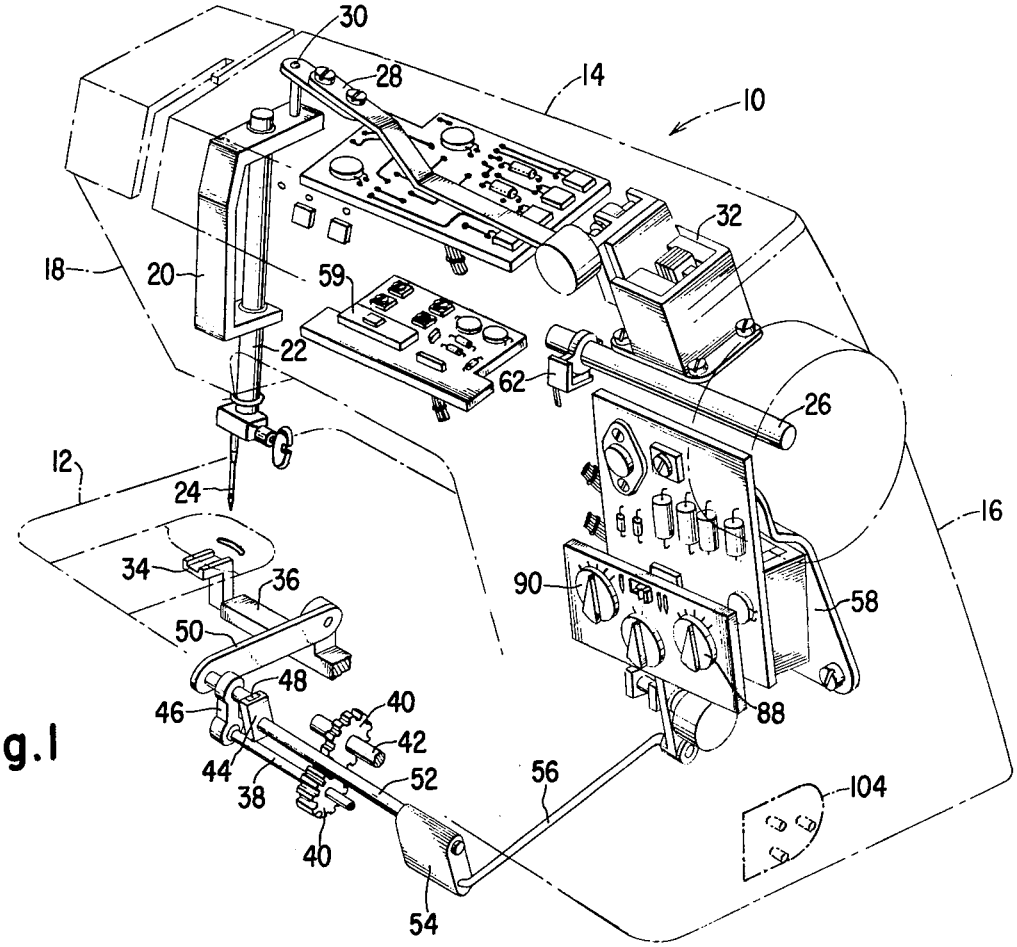
FIG. 1 is a perspective view of a sewing machine of the type used in the combination of the present invention with the frame thereof showing in phantom and components thereof shown in elevation.

Referring to the drawings, in FIG. 1 there is shown a sewing machine casing 10 illustrated in phantom lines which sewing machine includes a bed 12, a bracket arm 14 and a standard 16 interconnecting the bracket arm 14 with the bed 12 as illustrated. The bracket arm 14 terminates in a head portion 18 within which is supported in a conventional manner a needle bar gate 20 in which is supported for endwise reciprocation a needle bar 22 carrying at its lower end a needle 24. Endwise reciprocation is imparted to the needle. bar 22 by an arm shaft 26 which is rotated by an electric motor (not shown) and connected to the needle bar by a conventional sewing machine mechanism (not shown) such as an eccentric mechanism to convert the rotary motion of the arm shaft 26 to reciprocating motion of the needle bar 22.

An actuating arm 28 is connected to the needle bar gate 20 at pivotal connection 30 to convert reciprocating motion of the actuating arm 28 imparted by a linear motor or actuator 32 into pivotal motion of the needle bar gate 20. The linear motor 32 of the reversible type and may be of the same type as fully described in U.S. patent application Ser. No. 431,649, filed on Jan. 8, 1974, and assigned to the same assignee as the present invention. It will be seen therefore that the linear motor 32 may be used to determine the lateral position of the needle 24 as it penetrates the fabric disposed on the bed 12 to place a thread therethrough at a particular stitch position coordinate.

In order to feed the fabric across the bed 12 in the usual manner, a feed dog 34 is disposed beneath the bed and is supported by a feed bar 36. Work transporting motion is imparted to the feed dog by means of a feed drive shaft 38 driven by gears 40 which in turn are driven by a bed shaft 42 connected to the machine arm shaft 26 in timed relationship by a conventional mechanism (not shown). A cam 44 is connected to a pitman 46 through a slide block 48 which is disposed in a slot in the cam 44. The pitman 46 is also connected to a horizontal link 50 which in turn is pivotally connected to the feed bar 36 as shown. Thus for a given inclination of the cam 44, a predictable horizontal motion of the slide block will result which is transferred to the feed dog 34 by the horizontal link member 50 and the feed bar 36. The inclination of the cam 44 may be adjusted by rotation of regulator shaft 52 which is fixed to the cam 44. The regulator shaft 52 has a rock arm 54 fixed thereto at one end with the rock arm 54 having a rod 56 also connected thereto which in turn is connected to a second reversible linear motor or 58. Therefore, the linear motor 58 will be utilized to determine the feed rate of the sewing machine by determining the inclination of the cam 44.

Figure 3:
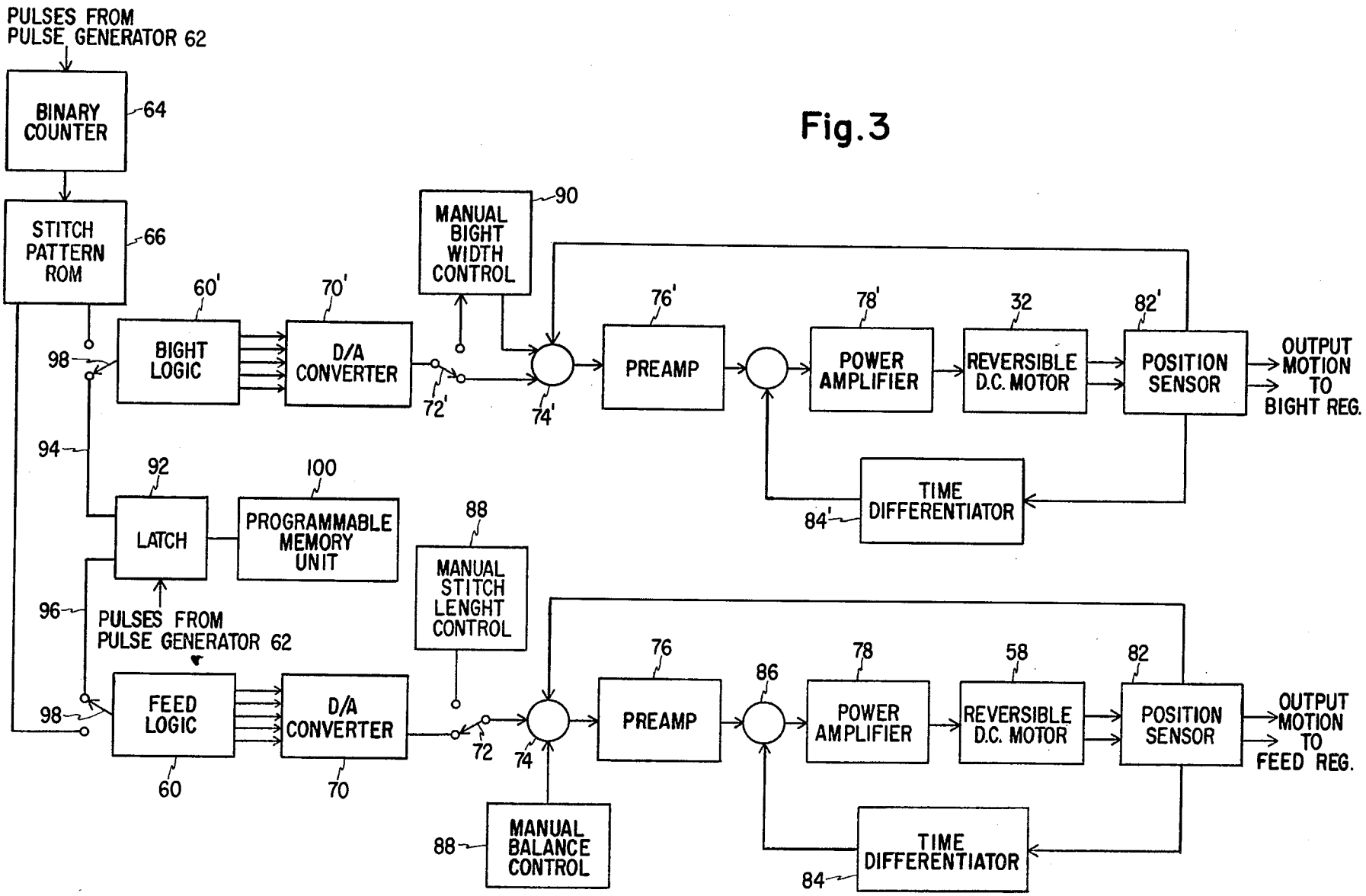
FIG. 3 is a general schematic block diagram of a system for adapting a static programmable memory unit to an existing machine having electronic stitch pattern controls.

Referring now to FIG. 3, the general schematic block diagram is shown therein for the bight and feed control of the sewing machine. The portions of the block diagram for bight and feed control are substantially similar and it will suffice to describe the feed control only with similar numerals used for similar elements in the bight circuit except with the prime thereafter. The pattern information used for generating signals to drive the linear motors 32 and 58 preferably originates in a MOSFET Large Scale Integration (LSI) integrated circuit which is physically shown in FIG. 1 at 59 as a so-called Chip and may include a ROM, the bight logic and the feed logic portion of the electronic circuitry. A pulse generator 62 is supported on the main shaft 26 and is operative to generate pulses which are counted up in the binary counter 64 (FIG. 3) and presented as address inputs to the stitch pattern ROM 66 which is encoded to produce as output therefrom five bits of bight information and five bits of feed information as indicated as the output from the feed logic 60 and the bight logic 60'. The feed information is processed in the logic block 60 and may include a latch whereby the feed information may be held for later release to the feed servo system at a time appropriate to the operation of the feed mechanism. Similarly, the bight information is processed in logic block 60' and may include a latch whereby the bight information may be held for a later release to the bight servo system at a time appropriate to the operation of the needle jogging mechanism. As mentioned above, since the servo systems for the bight and for the feed are identical except for the specific switching necessary for manual over-ride and balance control in the feed regulating system. The following description will for convenience be confined to the feed system only.

The information processed by the feed logic block 60 is presented to the digital-to-analog converter 70, which may be a commercially obtainable unit such as the type known as the MOTOROLA MC 1406 Unit. The converter 70 has an output which is a DC analog voltage representing a required feed position input. This line connects, in the automotic mode position of a switch 72, to a summing point 74 of a low level preamplifier 76 forming the first stage of a servo amplifier system. The switch 72 may comprise an FET switch. The preamplifier 76 drives a power amplifier 78 which supplies direct current of reversible polarity to the electromechanical actuator or linear motor 58, which in its broadest sense comprise a reversible motor, to position the actuator 58 in accordance with the input analog voltage from the converter 70. A feedback position sensor 82 mechanically connected to the actuator 58 provides a feedback position signal indicative of the existing output position. The input analog voltage and a feedback signal are algebraically summed at the summing point 86 to supply an error signal. The feedback signal from the position sensor 82 is also differentiated with respect to time in a differentiator 84 and the resulting rate signal is presented to the summing point 86 of the power amplifier 78 to modify the positional signal at that point. The position sensor 82 may be any device that generates an analog voltage proportional to position and may, in this embodiment, be a simple linear potentiometer connected to a stable reference voltage and functioning as a voltage divider. The differentiator 84 is preferably an operational amplifier connected to produce an output signal equal to the time rate of change of the input voltage, as is well known in this art.

While the actuators 32 and 58 may be a conventional low-inertia rotary D.C. motor, it is preferable for the purpose of the present invention that they take the form of a linear actuators in which a light-weight coil moves linearly in a constant flux field and is directly coupled to the load to be positioned. This simplifies the driving mechanical linkage and minimizes the load inertia of the system. A switch 72 shown in the automatic mode position in FIG. 3 may be operated from the automatic position to another position referred to as the manual position. In this position the analog position voltage from the converter 70 is disconnected from summing point 74 and the voltage from a potentiometer 88 is substituted therefore. Reference may be made to copending U.S. patent application Ser. No. 596,683 July 16, 1975, and assigned to the same assignee as the present application for a more complete description of the manual stitch length control system.

Referring now to the bight control system illustrated in FIG. 3, a switch 72' shown in the automatic mode position may be operated also in a manual position for connecting into the circuit a manual bight width control circuit 90. Switches 72' and 72 may comprise F.E.T. switches. In changing the switch 72' to the manual position, a potentiometer, indicated as the manual bight width control 90, is inserted into the circuit and acts as a scaling rheostat for the analog bight voltage from the converter 70' to provide any desired fraction of this voltage at the summing point 74' and so provides convenient means for narrowing or altering the pattern.

As further shown in FIG. 3, signals may be directed from a latch 92, which is set by each pulse received from the pulse generator 62, to provide an output on line 94 to the bight logic 60' and an output on line 96 to the feed logic 60. F.E.T. switches 98 may be used selectively to connect the bight logic 60' and the feed logic 60 to the output of a static programmable memory unit 100 or to the stitch pattern read-only-memory 66 of the sewing machine. Preferably the switch 98 is a ganged switch comprising the individual switches 98 shown connected to the bight logic 60' and the feed logic 60 so that the switches will be simultaneously shifted from association with the ROM 66 to association with the programmable memory unit 100. The purpose of switching from the ROM 66 to the programmable unit 100 will be more clearly described hereinafter.

The programmable memory unit 100 is therefore compatible with the use of a stitch pattern read-only-memory unit 66 in a sewing machine in which the stitch position coordinate pattern data is electrically extracted and manipulated. The combination and selective use of the two types of memory devices disclosed herein provides a convenient means whereby operator generated stitch patterns may be implemented while retaining in the machine the ability to select from a permanently stored memory those patterns which may be most frequently utilized.

Figure 4:
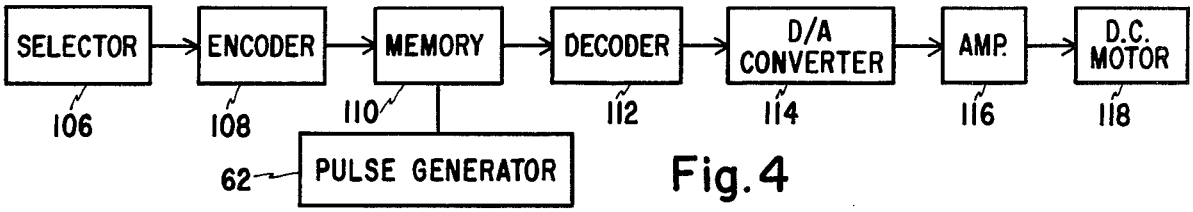
FIG. 4 is a schematic block diagram showing the components of the programmable memory device illustrated in FIG. 2 and their connection to a sewing machine actuator or control mechanism.
Figure 5:
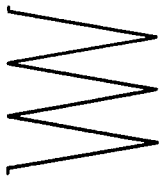
FIG. 5 is a table of encoded data for the production of four different stitch patterns with each stitch pattern being pictorially represented and having alongside each the bight and feed information in binary code as well as the name of each pattern.
Figure 5:
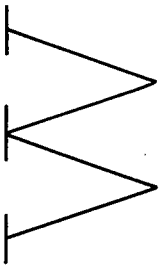
Figure 5:
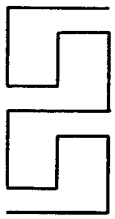
Figure 5:
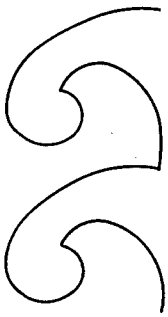

As mentioned above, it is the purpose of the invention to provide a novel combination of a programmable memory with an electronic sewing machine in which the operator can select patterns for storage in a memory device which can be reproduced by sewing machine. For accomplishing this purpose a programmable memory 100 is provided for coupling to the sewing machine as through an electrical wire 102 having a plug (not shown) for connection to a socket 104 on the sewing machine. The socket 104 may include provision for actuating the switch 98 to disengage the ROM 66 and actively couple the pulse generator 62, binary counter 64 and programmable memory unit 100 to the machine. Also, electrical current may be supplied to the memory unit 100 from the machine which is connected to an alternating current source in a known manner. The programmable memory unit 100 is of the digital type and includes appropriate selector buttons on the face plate thereof illustrated as buttons, 0 and 1 for insertion of a digital code preferably in binary form, into the memory of the memory unit 100. As schematically shown in block diagram form in FIG. 4, the memory unit 100 preferably includes a selector 106 connected to a binary encoder 108 connected in turn to the memory 110 which is a random access-type memory, as described above. In accordance with the statement of the invention, above, properly encoded digital information, such as is shown in FIG. 5, may be inserted directly into the memory 110 without the necessity for the encoder 108. Alternatively, a decimal digital code may be used which will require encoding to a binary digital code acceptable by the memory 110. As further illustrated in FIG. 4, when the memory unit 100 is connected to the sewing machine it will be coupled to the bight and feed logic, diagrammatically illustrated as 112, as a decoder, which comprises both the bight and feed logic, and to a digital-to-analog converter 114 which may include the converters 70 and 70', shown in FIG. 3, and then to the amplifier circuits 116 including the preamps and power amplifiers 76, 76' and 78, 78', and finally to the reversible DC motors 32, 58, illustrated in FIG. 4 as DC motor 118. As in the description of FIG. 3 above, a pulse generator 62 is used to address the memory 110 to withdraw therefrom the appropriate stored signals.

The programmable memory unit 100 shown in FIG. 2 also includes selector switches "P" for initiating a program, previously referred to digital code buttons 0 and 1, and a load selector switch "L" which is used to load into a display (see below) the digital code for the bight or feed selected, as will be described hereinafter. Visual displays are provided on the upper part of the panel which may be LED type displays for the bight and feed codes. Also on the upper portion of the panel is an on-off switch for independently turning the programmable memory unit on or off and a button indicated as "R" for changing the polarity of an introduced signal as for when reverse feed is desired in a pattern, such as illustrated in FIG. 5 in the column headed ±.

The operation of the remote programmable memory unit 100 for selecting a pattern will be best understood in referring to both FIGS. 2 and 5. As shown in FIG. 5 a number of patterns are illustrated therein which may be provided in a pattern book or pattern cards for the operator which are reduced to their appropriate digital code for use by the operator. For example, if the operator should wish to program in a zig-zag pattern, which is the first pattern shown in FIG. 5, the operator would turn to the page of the pattern code book in which this pattern is located, make sure the memory unit 100 is turned on and push the program button P to initiate the start of a program. For the first stitch labeled stitch one, FIG. 5, for the zig-zag pattern, in order to introduce the bight code for the first portion of the stitch the operator would push the selector button marked 0 four times. Since the polarity for the field is indicated as 0, which in this case may be a plus for forward feed, the selector "R" need not be pushed. After the selection of the first bight coordinates, namely 0000, the operator would push the load button, "L," whereupon the first bight coordinates would be indicated in the official display marked bight on the panel of the unit 100. Upon pushing the load button the device would automatically be prepared to receive the next stitch information which would be the feed portion of the first stitch coordinate. At that time, the operator would then push the appropriate button, namely the 0 button and push said button four times to enter in the appropriate feed signal, namely 0000. The operator would then again push the load button whereupon the first stitch point signal would be indicated on the feed LED display. The operator would then push the program button P whereupon both the bight and feed for the first stitch coordinate would be loaded into the memory. The same sequence would be followed for stitch coordinates 2 and 3, etc., for each pattern selected until all of the stitch coordinates are inserted into the memory for the particular selected pattern. In order to then reproduce the patterns in the sewing machine the operator would push the "S" start button and upon application of voltage to the machine, as by a foot controller or the like, the appropriate stitch pattern signals would be fed from the memory unit into the logic circuit of the sewing machine which would reproduce the pattern in accordance with the description of the electronic sewing machine of above.

Figure 6:
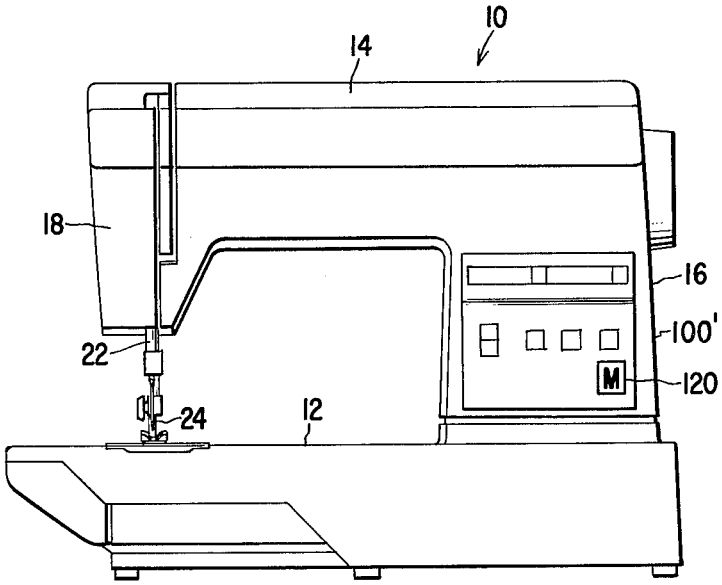
FIG. 6 is a front plan view of a sewing machine illustrating another embodiment with a static re-programmable memory and, FIG. 7 is a top plan view of another embodiment of a static re-programmable memory device.

Referring now to FIG. 6, the programmable memory unit is illustrated therein as being integral with the frame of the sewing machine. In other words, instead of having a remote programmable memory of the type shown in FIG. 2, it is also within the scope of the invention to provide a similar programmable memory unit 100' but built into the frame of the machine so that the operator may program patterns into the machine directly on the face plate thereof. In this embodiment a switch button 120 may be provided for activating or deactivating the switch 98 to substitute the programmable memory unit 100' for the ROM 66. It should be understood, however, that it is within the scope of the invention to provide only a programmable memory without an ROM so that each pattern selected by the operator must be programmed in by the operator.

In operation, once a particular pattern is programmed into the memory units 100 or 100' and the sewing machine is activated the pattern will be continually reproduced as long as that program is in the memory unit. In order to select another pattern the operator need merely push the program button on the program memory unit 100 or 100' and insert a new pattern which will then be recorded in the memory in place of the previously selected pattern. Alternatively of course, the programmable memory unit may be disconnected or switched off whereupon patterns provided in the ROM may be utilized. The programmable memory units 100, 100' are only intended to be illustrative of one type of remote programmable memory unit which may be used in the novel combination and other known types of programmable memory units may be adapted for use in combination with the electronic sewing machine described herein. For example, a programmable memory unit of the type manufactured by The Singer Company and known as Model 1500 may be adapted for such use since it has a keyboard through which a digital code input may be fed into a random access memory bank to store the ditital code information or to address a main random access memory having previously been programmed with stitch position coordinate information.

Referring now to FIG. 7, there is shown therein another embodiment of a selector means 122 by which an operator can visually reproduce a desired pattern on the surface 124 thereof. As shown in FIG. 7, the surface 124 of the selector 122 is provided with a matrix of points 126. Each point 126 is appropriately used for designating an individual stitch position coordinate in digital output signals for the bight and for the feed. Thus referring to FIG. 7, for the stitch position 1, which is illustrated with a number 1 in a circle, point 126 at this position will indicate a digital code of 0000 for the feed and 0000 for the bight. At point 126 at stitch position 2, indicated as the number 2 in a circle, a digital code of 0010 will be indicated for the feed and 0000 for the bight. It will be seen therefore that for each pattern physically drawn or reproduced on the surface 124 of the selector 122 appropriate digital information may be selected. The bight and feed digital information is indicated horizontally and vertically alongside the selector 122 in FIG. 7 to illustrate the digital output information required for each point 126.

It will be seen from the above description that a novel combination of a programmable memory device and an electronic sewing machine is provided wherein the operator may select any number of patterns which can be put into the memory and reproduced by the sewing machine. The programmable memory may be used in combination with a read-only-memory contained within the machine and having a fixed number of patterns, or can be used separately to program the machine for all patterns. Thus, with the use of the novel combination of the present invention an operator can reproduce substantially an infinite number of patterns limited only by the capability of the sewing instrumentalities of the machine itself. While the invention has been described in this preferred embodiment, it will be obvious to those skilled in the art that various changes and modifications may be made without departing from the spirit and scope thereof as defined in the appended claims.

Having thus set forth the nature of the invention, what is claimed herein is:

1. In a sewing machine having stitch forming means operative to form successive stitches including mechanism for influencing the stitch position coordinates of said successive stitches in the formation of a pattern of stitches, logic means responsive to input data representative of stitch position coordinates for producing stitch position coordinate electrical signals, actuating means responsive to signals from said logic means for controlling the position of said stitch forming means in accordance with input data fed to said logic means, and reprogrammable programming means operably connected to said sewing machine, said programming means including operator manipulating means for generating stitch by stitch digital input data corresponding to a stitch pattern selected by the operator and read-write static memory means continuously available for storing said digital input data while connected to said sewing machine and for transmitting electrical digital output signals corresponding to the stitch pattern selected by the operator to said logic means such that an operator may select a stitch pattern program for entry into the sewing machine for automatic reproduction of the stitch pattern by the sewing machine.

2. In a sewing machine as recited in claim 1 wherein said programming means comprises a programmable memory unit with said programmable unit being electrically connected to said logic means.

3. In a sewing machine as recited in claim 2 wherein said programmable unit is disposed remote from said sewing machine and electrically connected thereto and is readily detachable from said sewing machine.

4. In a sewing machine as recited in claim 2 wherein said programmable unit is integral with said sewing machine.

5. In a sewing machine as recited in claim 2 wherein said operator manipulating means of said programmable unit includes selector means operative in response to operator selection for generating selected bits of selected digital input data corresponding to a stitch of a stitch pattern selected by the operator, means for displaying said selected digital input data, and means for implementing storage of the displayed digital input data in said static memory means.

6. In a sewing machine as recited in claim 5 further comprising stitch pattern code means defining discrete stitch patterns in digital code, and said selector means being operative to produce digital input data corresponding to said stitch pattern code.

7. In a sewing machine as recited in claim 2 wherein said sewing machine includes an electronic read-only-memory unit for storing stitch position coordinate data, said logic means being electrically connected with said-only-memory unit for extracting said stitch position coordinated data and means for electrically disconnecting said read-only-memory unit when said programmable memory unit is electrically connected to said logic means.

8. In a sewing machine as recited in claim 7 wherein said programmable memory unit is readily detachable from said sewing machine and includes plug means for electrical connection with said sewing machine, and switch means cooperable with said plug means for electrically disconnecting said read-only-memory unit when said plug means is electrically connected to said sewing machine.

9. In a sewing machine having stitch forming means operative to form successive stitches including mechanism for influencing the stitch position coordinates of said successive stitches in the formation of a pattern of stitches, electric motor means operative in response to stitch position coordinate electric signals for initiating movement of said mechanism to stitch coordinate positions corresponding to said electric signals, means for providing stitch position coordinate electric signals including a static random access memory continuously available for storing new digital stitch position coordinate information while connected to said sewing machine, selector means for generating digital stitch position coordinate code information corresponding to a selected pattern of stitches and for inputing the generated digital stitch position coordinate code information into said random access memory, pulse generating means operable in timed sequence with the operation of said sewing machine and including means for addressing said random access memory for sequentially extracting digital stitch position coordinate information therefrom corresponding to the stitch position coordinates necessary to reproduce the selected pattern, means for converting the digital stitch position coordinate information extracted from said random access memory into electric signals each having a value corresponding to a particular stitch position coordinate necessary to reproduce the selected pattern, and said means for converting the digital stitch position coordinate information into electric signals being connected to said electric motor means for initiating movement of said mechanism to a position wherein said stitch forming means will produce a stitch at the ppropriate stitch position coordinate.

10. In a sewing machine as recited in claim 9 wherein said selector means is located remote from the sewing machine and is electrically connected thereto.

11. In a sewing machine as recited in claim 9 wherein said selector means, said static random access memory and said means for addressing said static random access memory are combined in a programmable memory unit.

12. In a sewing machine as recited in claim 9 wherein said selector means includes means for visually displaying the digital stitch position coordinate code information generated by the operator.

13. A programmable memory unit for a sewing machine having stitch forming means operative to form successive stitches including mechanism for influencing the stitch position coordinates of said successive stitches in the formation of a pattern of stitches, logic means responsive to input data representative of stitch position coordinates for producing stitch position coordinate electrical signals, actuating means responsive to signals from said logic means for controlling the position of said stitch forming means in accordance with input data fed to said logic means, and means for initiating actuation of successive stitches in the formation of said pattern of stitches, and programmable memory unit comprising:

programming means including operator manipulating means for generating stitch by stitch digital input data corresponding to a stitch pattern selected by the operator and read-write static memory means continuously available for storing said digital input data while connected to said sewing machine and for transmitting electrical digital output signals corresponding to the stitch pattern selected by the operator to said logic means, and means for coupling said programmable memory unit to said initiating means and said logic means of said sewing machine, whereby an operator may select a stitch pattern program in digital form for entry into said programming means for automatic reproduction of the stitch pattern by the sewing machine.

14. A programmable memory unit as claimed in claim 13 wherein said operator manipulating means of said programmable unit includes selector means operative in response to operator selection for generating selected bits of selected digital input data corresponding to a stitch of a stitch pattern selected by the operator, means for displaying said selected digital input data, and means for implementing storage of the displayed digital input data in said static memory means.

* * * * *